US006291936B1

(12) United States Patent
MacLennan et al.

(10) Patent No.: US 6,291,936 B1
(45) **Date of Patent: *Sep. 18, 2001**

(54) DISCHARGE LAMP WITH REFLECTIVE JACKET

(75) Inventors: Donald A. MacLennan, Gaithersburg; Brian P. Turner, Damascus; Kent Kipling, Gaithersburg, all of MD (US)

(73) Assignee: Fusion Lighting, Inc., Rockville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/147,309

(22) PCT Filed: May 29, 1997

(86) PCT No.: PCT/US97/10490

§ 371 Date: Nov. 25, 1998

§ 102(e) Date: Nov. 25, 1998

(87) PCT Pub. No.: WO97/45858

PCT Pub. Date: Dec. 4, 1997

Related U.S. Application Data

(63) Continuation-in-part of application No. 08/865,516, filed on May 29, 1997, now Pat. No. 5,903,091, and a continuation-in-part of application No. 08/656,381, filed on May 31, 1996, now abandoned.

(51) Int. Cl.[7] ..... H01J 65/04
(52) U.S. Cl. ..... 315/39; 315/248
(58) Field of Search ..... 315/39, 248

(56) References Cited

U.S. PATENT DOCUMENTS

Re. 34,492 12/1993 Roberts ..... 359/48
2,135,480 11/1938 Birdseye ..... 176/124
3,042,795 7/1962 Kron ..... 240/2

(List continued on next page.)

FOREIGN PATENT DOCUMENTS 0 628 987 12/1994 (EP) ..... H01J/61/40
52-146071 12/1977 (JP) ..... H01J/65/00

(List continued on next page.)

OTHER PUBLICATIONS

"Microwave Discharge Lighting", Mitsubishi Lighting Equipment Brochure (Apr. 1984).
Karyakin, N.A., "Light Devices", Moscow, Vysshaya shkola, pp. 183–184 (1976).

*Primary Examiner*—Benny T. Lee
(74) *Attorney, Agent, or Firm*—Paul E. Steiner

(57) ABSTRACT

A discharge lamp includes an envelope, a fill which emits light when excited disposed in the envelope, a source of excitation power coupled to the fill to excite the fill and cause the fill to emit light, and a reflector disposed around the envelope and defining an opening, the reflector being configured to reflect some of the light emitted by the fill back into the fill while allowing some light to exit through the opening. The reflector may be made from a material having a similar thermal index of expansion as compared to the envelope and which is closely spaced to the envelope. The envelope material may be quartz and the reflector material may be either silica or alumina. The reflector may be formed as a jacket having a rigid structure which does not adhere to the envelope. The lamp may further include an optical clement spaced from the envelope and configured to reflect an unwanted component of light which exited the envelope back into the envelope through the opening in the reflector. Light which can be beneficially recaptured includes selected wavelength regions, a selected polarization, and selected angular components.

15 Claims, 13 Drawing Sheets

U.S. PATENT DOCUMENTS

| | | | | |
|---|---|---|---|---|
| 3,763,392 | | 10/1973 | Hollister | 315/248 |
| 3,931,536 | | 1/1976 | Fohl et al. | 313/113 |
| 4,071,798 | | 1/1978 | Hammond | 313/18 |
| 4,119,889 | * | 10/1978 | Hollister | 315/248 |
| 4,501,993 | | 2/1985 | Mueller et al. | 315/248 |
| 4,532,427 | | 7/1985 | Matthews et al. | 250/492.2 |
| 4,633,126 | | 12/1986 | Giller et al. | 313/113 |
| 4,707,116 | | 11/1987 | Newiger et al. | 355/30 |
| 4,735,495 | | 4/1988 | Henkes | 350/345 |
| 4,757,427 | | 7/1988 | Oostvogels et al. | 362/32 |
| 4,792,716 | | 12/1988 | Walsh | 313/113 |
| 4,839,553 | | 6/1989 | Mellor | 313/111 |
| 4,872,741 | | 10/1989 | Dakin et al. | 350/345 |
| 4,877,991 | | 10/1989 | Colterjohn, Jr. | 313/22 |
| 4,950,059 | | 8/1990 | Roberts | 350/345 |
| 4,978,891 | | 12/1990 | Ury | 315/117 |
| 5,113,121 | | 5/1992 | Lapatovich et al. | 315/248 |
| 5,117,312 | | 5/1992 | Dolan | 359/858 |
| 5,130,913 | | 7/1992 | David | 362/345 |
| 5,168,193 | | 12/1992 | Hoegler | 313/113 |
| 5,177,396 | | 1/1993 | Gielen et al. | 313/113 |
| 5,378,965 | | 1/1995 | Dakin et al. | 315/248 |
| 5,404,076 | | 4/1995 | Dolan et al. | 313/572 |
| 5,514,932 | | 5/1996 | Willibrordus et al. | 313/489 |
| 5,541,475 | | 7/1996 | Wood et al. | 313/484 |
| 5,587,626 | | 12/1996 | Parham et al. | 313/634 |
| 5,606,220 | | 2/1997 | Dolan et al. | 313/637 |
| 5,610,469 | | 3/1997 | Bergman et al. | 313/25 |
| 5,773,918 | * | 6/1998 | Dolan et al. | 315/248 X |
| 5,903,091 | * | 5/1999 | MacLennan et al. | 315/248 X |
| 5,990,624 | * | 11/1999 | Maya | 315/39 |

FOREIGN PATENT DOCUMENTS

| | | | |
|---|---|---|---|
| 52-160274 | 12/1977 | (JP) | H01J/65/04 |
| 53-40688 | 4/1978 | (JP) | H01J/65/00 |
| 57-148764 | 9/1982 | (JP) | H01J/65/04 |
| 60-117539 | 6/1985 | (JP) | H01J/65/00 |
| 63-40579 | 3/1988 | (JP) | H01J/65/04 |
| 63-138760 | 9/1988 | (JP) | H01J/65/04 |
| 63-292561 | 11/1988 | (JP) | H01J/65/04 |
| 63-292562 | 11/1988 | (JP) | H01J/65/04 |
| 1-143066 | 9/1989 | (JP) | H01J/65/04 |
| 92/08240 | 5/1992 | (WO) | H01J/61/18 |
| 93/21655 | 10/1993 | (WO) | H01J/61/38 |
| 94/08439 | 4/1994 | (WO) | H05B/41/16 |
| 95/10847 | 4/1995 | (WO) | H01J/17/16 |
| 95/28069 | 10/1995 | (WO) | H05B/41/16 |
| 97/45858 | 12/1997 | (WO) | H01J/61/12 |

* cited by examiner

DISCHARGE LAMP WITH REFLECTIVE JACKET

CROSS REFERENCE TO RELATED APPLICATIONS

The present application is a continuation-in-part of U.S. application Ser. No. 08/656,381, filed May 31, 1996, now U.S. Pat. No. 5,903,091 which is a continuation-in-part of 08/865,516 filed May 29, 1997 now U.S. Pat. No. 5,903,091.

This invention was made with Government Support under Contract No. DE-FG01-95EE23796 awarded by the Department of Energy. The Government has certain rights in this invention.

BACKGROUND

The present invention is directed to an improved method of generating visible light and to an improved bulb and lamp for providing such light.

U.S. Pat. Nos. 5,404,076, and 5,606,220, and PCT Publication No. WO 92/08240, which are incorporated herein by reference, disclose lamps for providing visible light which utilize sulfur and selenium based fills. Co-pending U.S. application Ser. No. 08/324,149, filed Oct. 17, 1994, now U.S. Pat. No. 5,661,365 also incorporated herein by reference, discloses similar lamps for providing visible light which utilize a tellurium based fill.

These sulfur, selenium and tellurium lamps of the prior art provide light having a good color rendering index with high efficacy. Additionally the electrodeless versions of these lamps have a very long lifetime.

Most practical embodiments of sulfur, selenium, and tellurium lamps have required bulb rotation in order to operate properly. This is disclosed in PCT Publication No. WO 94/08439, where it is noted that in the absence of bulb rotation, an isolated or filamentary discharge results, which does not substantially fill the inside of the bulb.

The requirement of rotation which was generally present in the prior art lamps introduced certain complications. Thus, the bulb is rotated by a motor, which has the potential for failure, and which may be a limiting factor on the lifetime of the lamp. Furthermore, additional components are necessary, thereby making the lamp more complex and requiring the stocking of more spare parts. It therefore would be desirable to provide a lamp affording the advantages of the prior sulfur, selenium and tellurium lamps, but which does not require rotation.

PCT Publication No. WO 95/28069, a Dewar lamp was disclosed for purportedly obviating rotation. However, a problem with such Dewar configuration is that it is complicated in that it utilizes peripheral and central plated electrodes on the bulb, and the central electrode is prone to overheating.

SUMMARY

The present invention provides a method of generating visible light, and a bulb and lamp for use in such method which eliminates or reduces the need for bulb rotation.

The invention affords increased design flexibility in providing lamp bulbs of smaller dimensions and/or utilizing sulfur, selenium or tellurium fills having lower density of active substances than in the prior art, which are still capable of providing a primarily visible light output. This, for example, facilitates the provision of low power lamps, which may lend themselves to the use of smaller bulbs. This feature of the invention may be used in combination with other features, or independently. For example, a smaller bulb may be provided either which doesn't rotate, or which does rotate.

In accordance with a first aspect of the present invention, a method is provided utilizing a lamp fill which upon excitation, contains at least one substance selected from the group of sulfur and selenium; the lamp fill is excited to cause said sulfur or selenium to produce radiation which includes a substantial spectral power component in the ultraviolet region of the spectrum, and a spectral power component in the visible region of the spectrum, the radiation is reflected a multiplicity of times through the fill in a contained space, thereby converting part of the radiation which is in the ultraviolet region to radiation which is in the visible region of the spectrum, which visible radiation is greater than it would have been if reflecting had occurred in the absence of the conversion. Finally, the visible radiation is emitted from the contained space.

In accordance with a further aspect of the invention, the fill is excited to cause the sulfur or selenium to produce a spectral power component in the ultraviolet and a spectral power component in the visible region, wherein the multiple reflections result in a reduced ultraviolet spectral component having a magnitude of at least 50% less than the original component.

In PCT Publication No. WO 93/21655 sulfur and selenium lamps are disclosed in which light is reflected back into the bulb to lower the color temperature of the emitted light or to make it more closely resemble the radiation of a black body. Unlike in the present invention, in the prior art system it is radiation having an essentially visible (and higher) spectral output which is reflected to produce another visible spectral output having more spectral power in the red region. In distinction to the prior art, in the present invention, the radiation which is reflected has substantial spectral power component in the ultraviolet region (i.e., at least 10% of the total of the ultraviolet and visible spectral power), of which some is converted to the visible region. It is this conversion of ultraviolet to visible radiation in the present invention by multiple reflections which allows a small bulb to replace a larger one and/or the use of a lower density of active material which allows stable operation to be achieved without rotating the bulb.

Inasmuch as the method of the invention involves multiple reflections of light through the fill, and finally to the outside, it was contemplated that a bulb be used which has a reflector layer around the quartz, except for an aperture through which the light exits. Such "aperture lamps" are known in the prior art, and an example is shown in U.S. Pat. No. Re 34,492 to Roberts.

The Roberts patent discloses an electrodeless spherical envelope having a reflective coating thereon, except for an aperture which is in registry with a light guide. However, it has been found that the Roberts structure is not suitable for practicing the method of the present invention as it would be employed in normal commercial use. This is because of its use of a coating on the lamp envelope. When the bulb heats up during use, the different thermal indices of expansion of the quartz envelope and the coating cause the coating to crack. Thus, the lifetime of the bull) is quite limited. Also, a coating is not normally thick enough to provide the degree of reflectivity which is required to provide adequate wavelength conversion from ultraviolet to visible.

In accordance with an aspect of the present invention, these problems are solved by utilizing a diffuse, reflecting ceramic covering for the bulb which contacts at least one location of the envelope, and which does not crack due to differential thermal expansion. In a first embodiment, the covering comprises a jacket which unlike a coating, is non-adherent to the bulb. The lack of adherence accommodates the thermal expansion of bulb and jacket without causing cracking of the jacket. Also, the jacket is made thick enough to provide high enough reflectivity to accomplish the desired wavelength conversion. In a second embodiment, the reflective bulb covering is made of the same material as the bulb, so that there is no problem with differential thermal expansion. In this embodiment, the covering may additionally be in the form of a non-adherent jacket. In a further embodiment, a diffusely reflecting powder is disposed between a jacket and the bulb.

BRIEF DESCRIPTION OF THE DRAWINGS

The invention will be better understood by referring to the accompanying drawings, wherein similar elements are generally identified by like reference numerals.

DESCRIPTION

Figure 1:
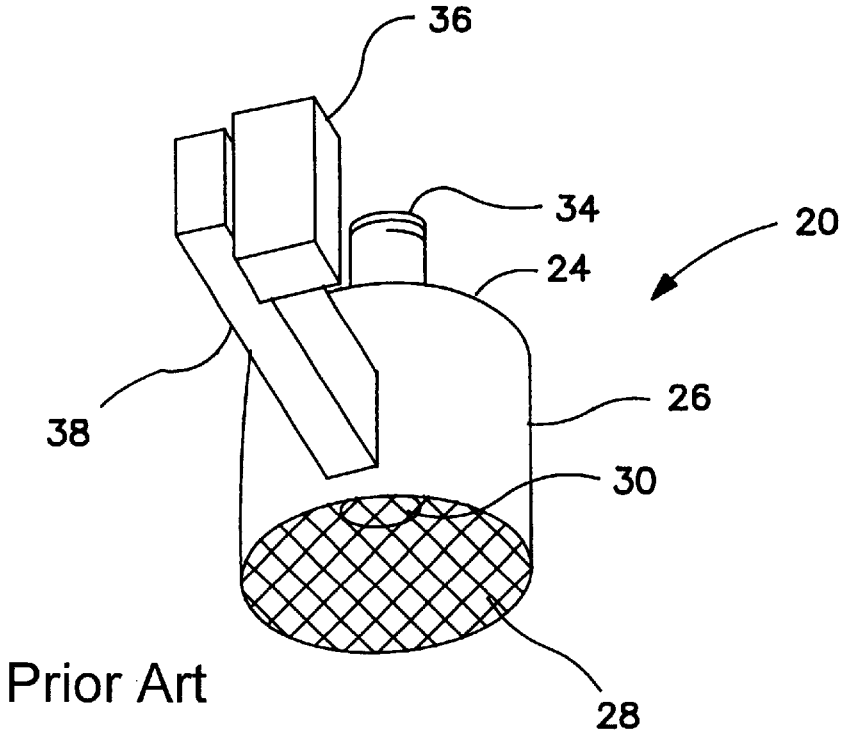
Prior Art FIG. 1
FIG. 1 shows a prior art lamp having a sulfur, selenium or tellurium based fill.

Referring to FIG. 1, a prior art lamp having a fill which upon excitation contains sulfur, selenium, or tellurium, is depicted. As described in the above-mentioned patents which are incorporated herein by reference, the light provided is molecular radiation which is principally in the visible region of the spectrum.

Lamp 20 includes a microwave cavity 24 which is comprised of metallic cylindrical member 26 and metallic mesh 28. Mesh 28 allows light to escape from the cavity while retaining most of the microwave energy inside.

Bulb 30 is disposed in the cavity, which in the embodiment depicted is spherical. The bulb is supported by a stem, which is connected with motor 34 for effecting rotation of the bulb. The rotation promotes stable operation of the lamp.

Microwave power is generated by magnetron 36, and waveguide 38 transmits such power to a slot (not shown) in the cavity wall, from where it is coupled to the cavity and particularly to the fill in bulb 30.

Bulb 30 is comprised of a bulb envelope and a fill in the envelope. In addition to containing a rare gas, the fill contains sulfur, selenium, or tellurium, or an appropriate sulfur, selenium, or tellurium compound. For example, InS, $As_2S_3$, $S_2Cl_2$, $CS_2$, $In_2S_3$, SeS, $SeO_2$, $SeCl_4$, SeTe, $SCe_2$, $P_2Se_5$, $Se_3As_2$, TeO, TeS, $TeCl_5$, $TeBr_5$, and $TeI_5$ may be used. Additional compounds which may be used are those which have a sufficiently low vapor pressure at room temperature, i.e., are a solid or a liquid, and which have a sufficiently high vapor pressure at operating temperature to provide useful illumination.

Before the invention of the sulfur, selenium, and tellurium lamps described above, the molecular spectra of these substances as generated by lamps known to the art were recognized to be primarily in the ultraviolet region. In the process performed by the sulfur, selenium, and/or tellurium lamp described in connection with FIG. 1, the radiation initially provided by the elemental sulfur, selenium, and/or tellurium (herein referred to as "active material" ) is similar to that in the prior art lamp, i.e., primarily in the ultraviolet region. However, as the radiation passes through the fill on its way to the envelope wall, it is converted by a process of absorption and re-emission into primarily visible radiation. The magnitude of the shift is directly related to the optical path length, i.e., the density of the active material in the fill multiplied by the diameter of the bulb. If a smaller bulb is used, a higher density of active material must be provided to efficiently produce the desired visible radiation while if a larger bulb is used, lower density of such substances may be used.

In accordance with an aspect of the present invention, the optical path length is greatly increased without increasing the diameter of the bulb by reflecting the radiation after it initially passes through the fill a multiplicity of times through the fill. Furthermore, the density of the active material and the bulb size are small enough so that the radiation which has initially passed through the fill and is being reflected may have a substantial spectral power component in the ultraviolet region. That is, in the absence of the multiple reflections, the spectrum which is emitted from the bulb might not be acceptable for use in a visible lamp. However, due to the multiple reflections, ultraviolet radiation is converted to visible, which produces a better spectrum. The multiple reflections through the fill permit the use of a smaller density of active material to provide an acceptable spectrum for any given application. Also, the smaller density fill has reduced electrical impedance, which in many embodiments provides better microwave or R.F. coupling to the fill. Operation at such smaller density of active material promotes stable operation, even without bulb rotation. Furthermore the capability of using smaller bulbs increases design flexibility, and for example, facilitates the provision of low power lamps. As used herein, the term "microwave" refers to a frequency band which is higher than that of "R.F.".

Figure 2:
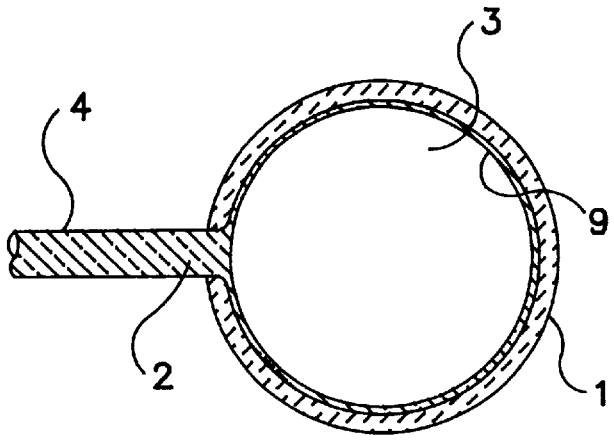
Prior Art FIG. 2
FIG. 2 shows an aperture lamp.

As mentioned above, since the method of the invention requires multiple reflections through the fill before the light is emitted to the outside, it was contemplated to use a bulb having a reflective layer thereon, except for an aperture, from which the light exits. A lamp of this type, which is disclosed in Roberts Patent No. RE 34,492, is shown in FIG. 2. Referring to FIG. 2, spherical envelope or bulb 9 which is typically made of quartz contains a discharge forming fill 3. The envelope bears a reflective coating 1 around the entire surface except for aperture 2, which is in registry with light guide 4.

However, as heretofore described, it was found that because the Roberts structure utilizes a coating which is by its nature adherent, (of a different material than the bulb) it is not suitable for practicing the method of the present invention. When the bulb heats up during normal commercial use, the different thermal indices of expansion of the quartz envelope and the coating cause the coating to crack. Thus, the lifetime of the device is quite limited. Also, a coating is not normally thick enough to provide the degree of reflectivity which is required to provide adequate wavelength conversion from ultraviolet to visible.

Figure 3:
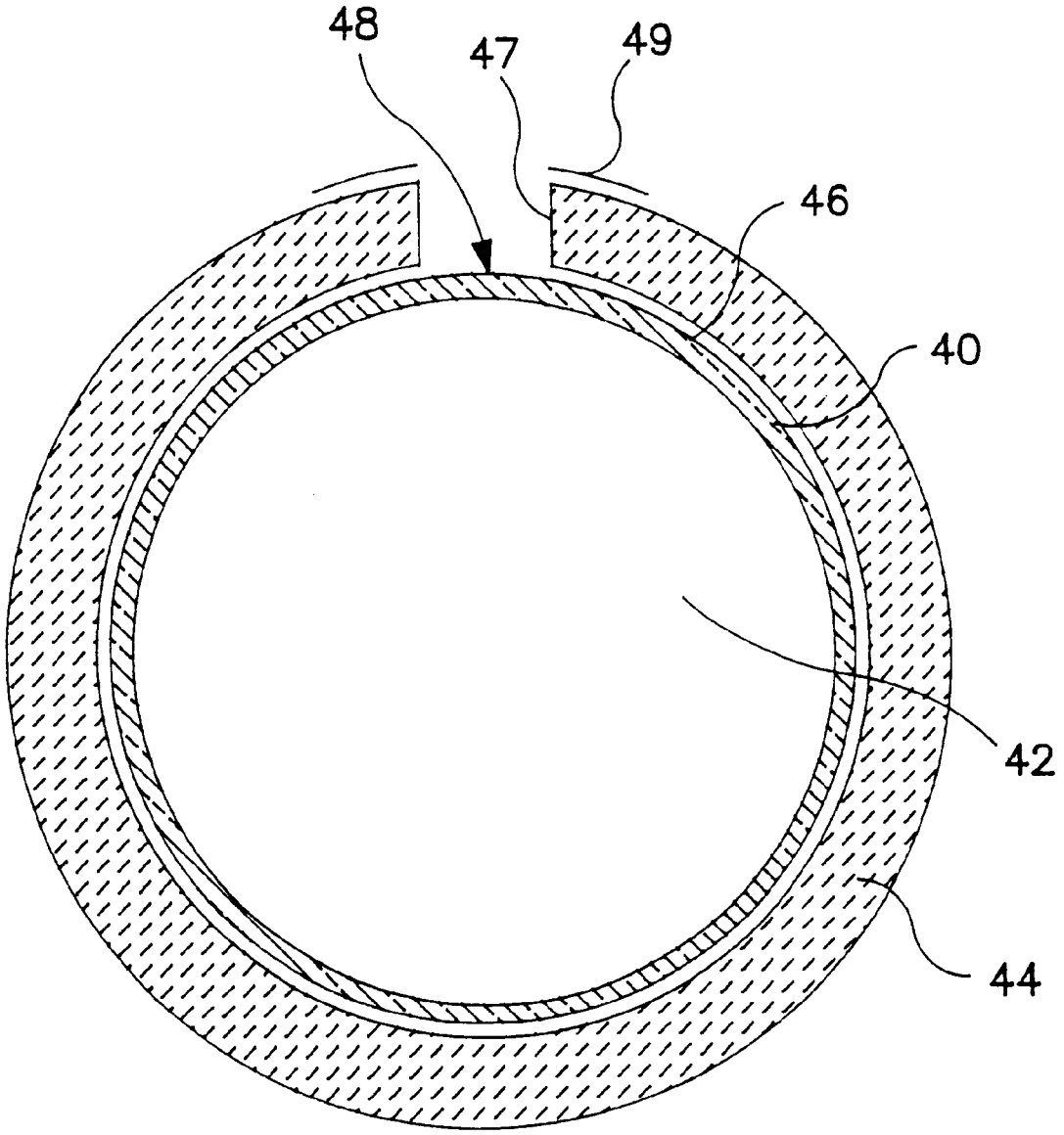
FIG. 3 shows an electrodeless lamp bulb in accordance with an embodiment of the invention.

Referring to FIG. 3, an embodiment in accordance with the present invention which solves these problems is depicted. Bulb 40 which encloses fill 42 is surrounded by non-adherent reflecting jacket 44. The jacket is made thick enough to provide high enough ultraviolet reflectivity to accomplish the desired wavelength conversion. There is an air gap 46 between the bulb and jacket which may be of the order of several thousandths of an inch. The jacket contacts the bulb at a minimum of one location, and may contact the bulb at multiple locations. There is an aperture 48 through which the light exits. Because the jacket does not adhere to the bulb, differential thermal expansion at operating temperatures is accommodated without causing cracking of the jacket.

In accordance with another embodiment, a diffusely reflecting powder such as alumina or other powder may be used to fill in the gap between the jacket and the bulb. In this case the gap may be somewhat wider.

In accordance with a further embodiment, a reflective bulb covering of ceramic is used which is made of the same material as the bulb. Hence, there is no problem with differential thermal expansion. Such covering may also be constructed so that there is no adherence to the bulb.

In one method of constructing a jacket, a sintered body is built up directly on the spherical bulb. It starts off as a powder, but is heated and pressurized so as to form a sintered solid. Since there is no adherence, when the jacket is cracked it will fall apart. Suitable materials are powdered alumina and silica, or combinations thereof. The jacket is made thick enough to provide the required UV and visible reflectivity as described herein and it is normally thicker than 0.5 mm and may be up to about 2 to 3 mm, which is much thicker than a coating.

Figure 4:
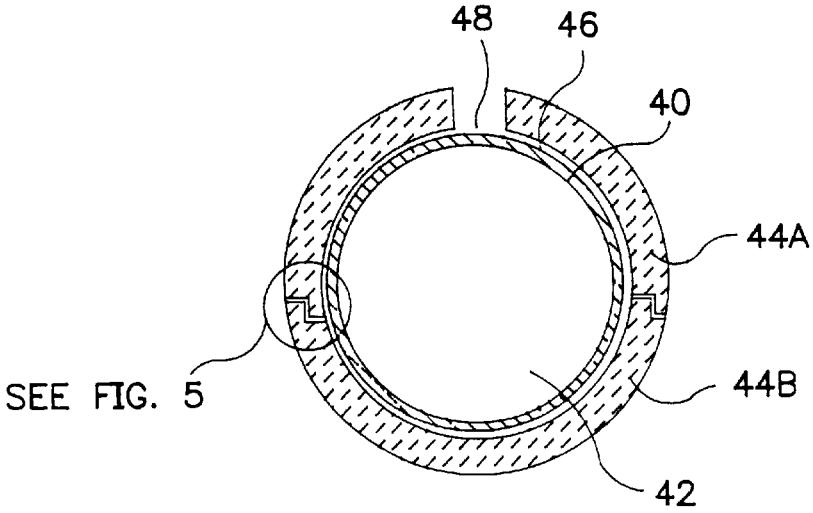
FIGS. 4 and 5 show a particular construction.
Figure 5:
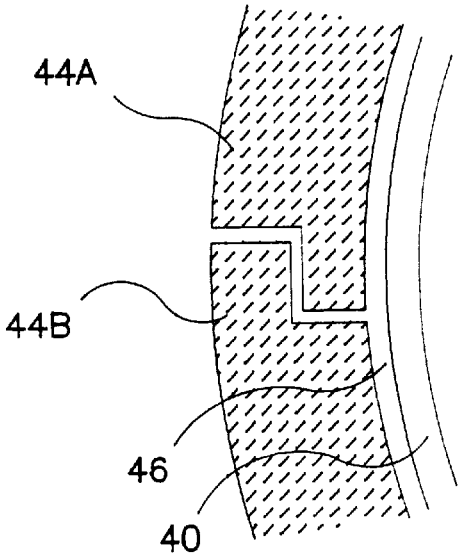

A jacket construction is illustrated in connection with FIGS. 4 and 5. In this case, the jacket is formed separately from the bulb. The quartz bulb is blow molded into a spherical form which results in a bulb that is dimensionally controlled for OD (outside diameter) and wall thickness. A filling tube is attached to the spherical bulb at the time of molding. For example a bulb of 7 mm OD and wall thickness of 0.5 mm filled with 0.05 mg Se and 500 Torr Xe has been operated in an inductivity coupled apparatus. The filling tube is removed so that only a short protrusion from the bulb remains. The jacket is formed of lightly sintered highly reflective alumina ($Al_2O_3$) in two pieces 44A and 44B as indicated in the FIG. 4. The particle size distribution and the crystalline structure of the jacket material must be capable of providing the desired optical properties. Alumina in powder form is sold by different manufacturers, and for example, alumina powder sold by Nichia America Corp. under the designation NP-999-42 may be suitable. The FIG. 4 is a cross-sectional view of the bulb, jacket, and aperture taken through the center of the bulb. The tip-off is not shown in the view. The ID (inside diameter) of the jacket is spherical in shape except the region near the tip-off, not shown. The partially sintered jacket is sintered to the degree that particle necking (attachment between the particles) can be observed on a micro-scale. The sintering is governed by the required thermal heat conductivity through the ceramic. The purpose of the necking is to enhance heat conduction while having minimal influence on the ceramic's reflectivity. The two halves of the ceramic are sized for a very close fit and can be held together by mechanical means or can be cemented using by way of example, the General Electric Arc Tube Coating No. 113-7-38. The jacket ID and bulb OD are chosen so that an average air gap allows adequate thermal heat conduction away from the bulb and the jacket thickness is chosen for required reflectivity. Bulbs have been operated with an air gap of several thousandths of an inch and a minimum ceramic thickness as thin as 1 mm.

In a further embodiment mentioned above, the material used for the bulb is quartz ($SiO_2$), and the reflective covering is silica ($SiO_2$). Since the materials are the same, there is no problem with differential thermal expansion. The silica is in amorphous form and is comprised of small pieces which are fused together lightly. It is made thick enough to achieve the desired reflectivity, and is white in color. The silica may also be applied in form of a non-adherent jacket.

While the apparatus aspects of the present invention described above and also in connection with FIGS. 6 to 13 have particular applicability when used with the sulfur, selenium and tellurium based fills referred to, they possess advantages which are fill independent, and thus may also be advantageously used with any fill, including various metal halide fills such as tin halide, indium halide, gallium halide, bromium halide (e.g. iodide), and thallium halide.

When used in connection with sulfur and selenium based fills, the material for jacket 44 in FIG. 3 is highly reflective in the ultraviolet and visible, and has a low absorption over these ranges and preferably also in the infrared. The coating reflects substantially all of the ultraviolet and visible radiation incident on it, meaning that its reflectivity in both the ultraviolet and visible portions of the spectrum is greater than 85%, over the ranges (UV and visible) at least between 330 nm and 730 nm. Such reflectivity is preferably greater than 97%, and most preferably greater than 99%. Reflectivity is defined as the total fraction of incident radiative power returned over the above-mentioned wavelength ranges to the interior. High reflectivity is desirable because any loss in light is multiplied by the number of reflections. Jacket 44 is preferably a diffuse reflector of the radiation, but could also be a specular reflector. The jacket reflects incident radiation regardless of the angle of incidence. The above-mentioned reflectivity percentages preferably extend throughout wavelengths well below 330 nm, for example, down to 250 nm and most preferably down to 220 nm.

It is also advantageous, although not necessary, for the jacket to be reflective in the infrared, so that the preferred material is highly reflective from the deep ultraviolet through the infrared. High infrared reflectivity is desirable because it improves the energy balance, and allows operation at lower power. The jacket must also be able to withstand the high temperatures which are generated in the bulb. As mentioned above, alumina and silica are suitable materials and are present in the form of a jacket which is thick enough to provide the required reflectivity and structural rigidity.

As described above, in the operation of the bulb utilizing sulfur or selenium, the multiple reflections of the radiation by the coating simulates the effect of a much larger bulb, permitting operation at a lower density of active material and/or with a smaller bulb. Each absorption and re-emission of an ensemble of photons including those corresponding to the substantial ultraviolet radiation which is reflected results in a shift of the spectral power to distribution towards longer wavelengths. The greater the average number of bounces of a photon with the bulb envelope, the greater the number of absorptions/re-emissions, and the greater the resulting shift in spectra associated with the photons. The spectral shift will be limited by the vibrational temperature of the active species.

While the aperture 48 in FIG. 3 is depicted as being unjacketed, it is preferably provided with a substance which has a high ultraviolet reflectivity, but a high transparency to visible radiation. An example of such a material is a multi-layer dielectric stack having the desired optical properties.

The parameter alpha is defined as the ratio of the aperture surface area to the entire area of the reflective surface, including aperture area. Alpha can thus take on values between near zero for a very small aperture to 0.5 for a half coated bull). The preferred alpha has a value in the range of 0.02 to 0.3 for many applications. The ratio alpha outside this range will also work but may be less effective, depending on the particular application. Smaller alpha values will typically increase brightness, reduce color temperature, and lower efficacy. Thus, an advantage of the invention is that a very bright light source can be provided.

Figure 6:
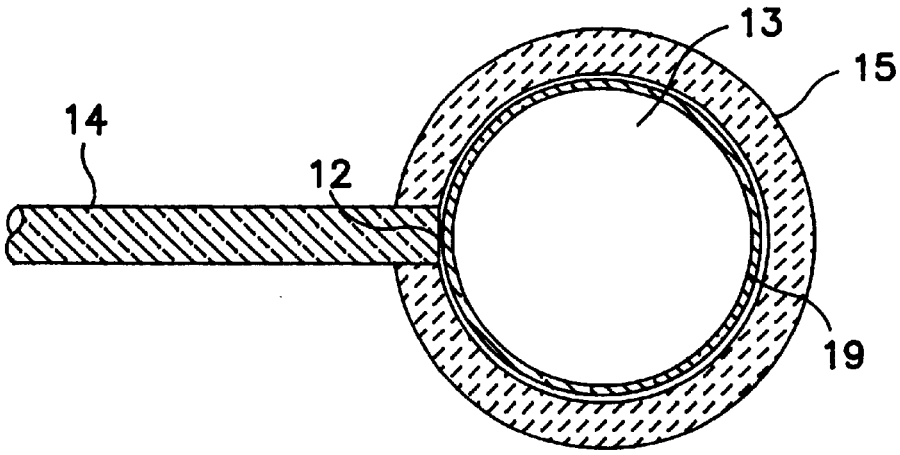
FIGS. 6 to 8 show further embodiments of the invention.

A further embodiment is shown in FIG. 6, which utilizes a light port in the form of fiber optic 14 which interfaces with the aperture 12. The area of the aperture is considered to be the cross-sectional area of the port. In the embodiment of FIG. 6, diffusely reflecting jacket 15 surrounds bulb 19 which encloses a fill 13.

Figure 7:
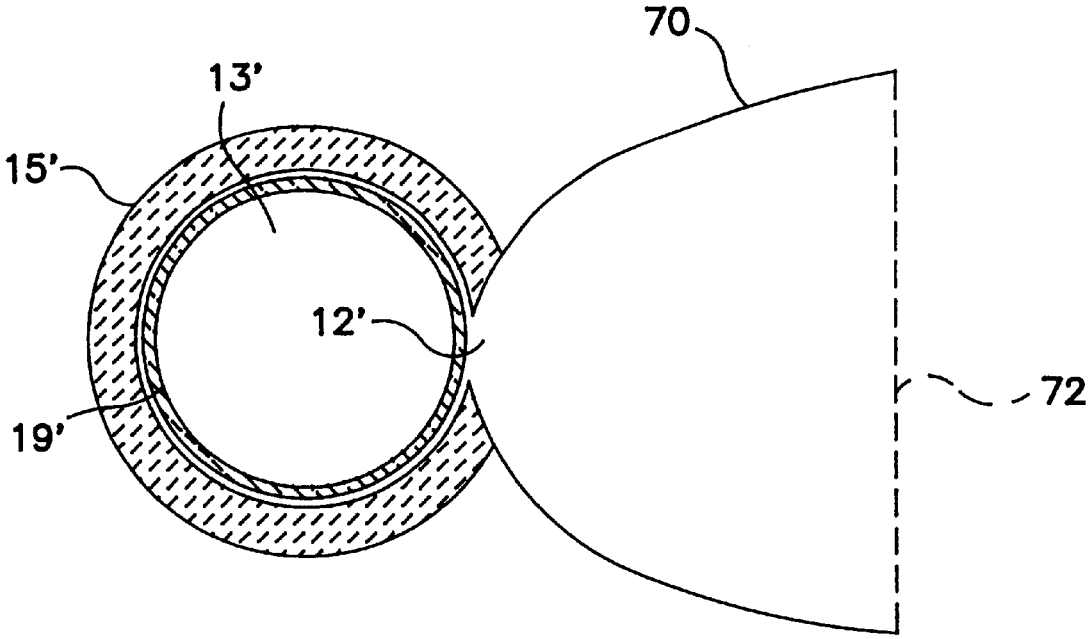

A further embodiment is shown in FIG. 7, where parts similar to those in. FIG. 6 are identified with like reference numerals. Referring to FIG. 7, the light port which interfaces with the aperture 12' is a compound parabolic reflector (CPC) 70. As is known, a CPC appears in cross-section as two parabolic members tilted towards each other at a tilt angle. It is effective to transform light having an angular distribution of from 0 to 90 degrees to a much smaller angular distribution, for example zero to ten degrees or less (a maximum of ten degrees from normal). The CPC can be either a reflector operating in air or a refractor using total internal reflection.

In the embodiment shown in FIG. 7, the CPC may be arranged, for example, by coating the inside surface of a reflecting CPC so as to reflect the ultraviolet and visible light, while end surface 72 is provided which passes visible light, but which may be configured or coated to reflect unwanted components of the radiation back through the aperture. Such unwanted components may for example, and without limitation, include particular wavelength region(s), particular polarization(s) and spatial orientation of rays (e.g. a particular angular distribution). Surface 72 is shown as a dashed line to connote that it both passes and reflects radiation.

Figure 8:
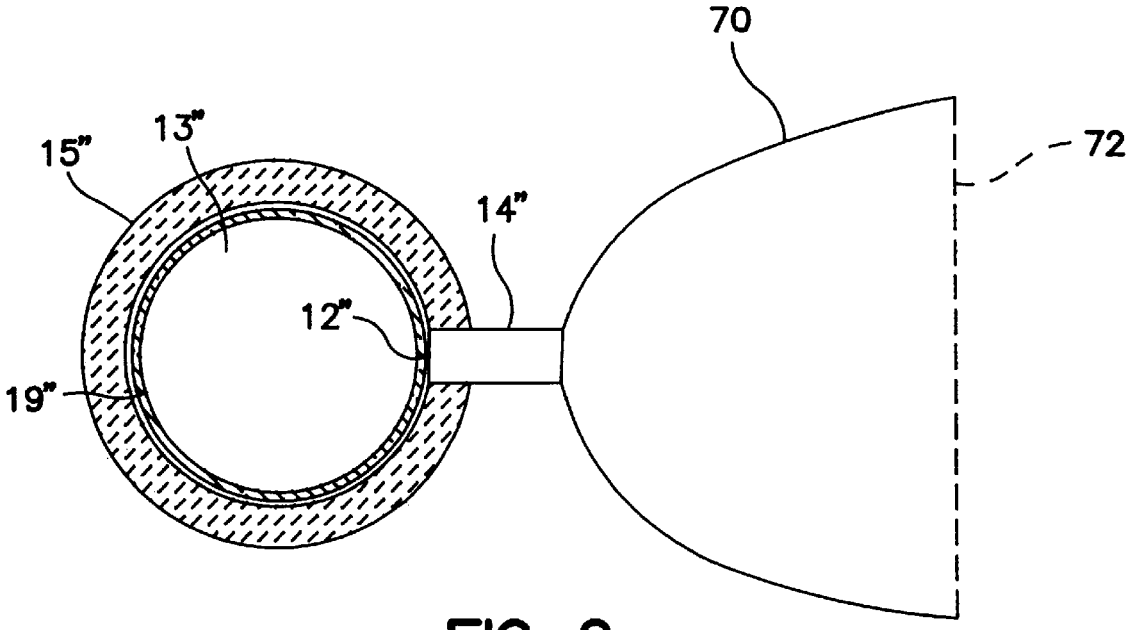
Figure 9:
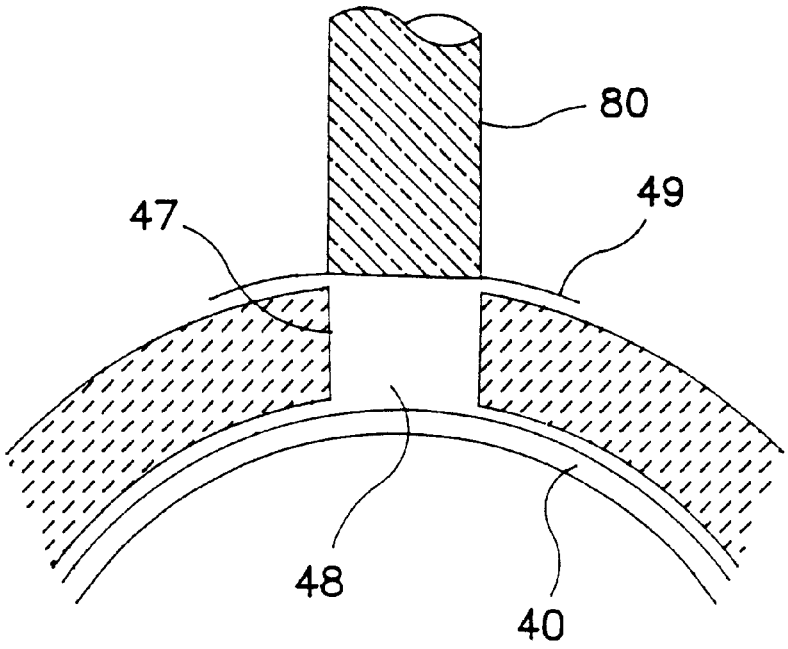
FIGS. 9 and 10 show the use of diffusing orifices.
Figure 10:
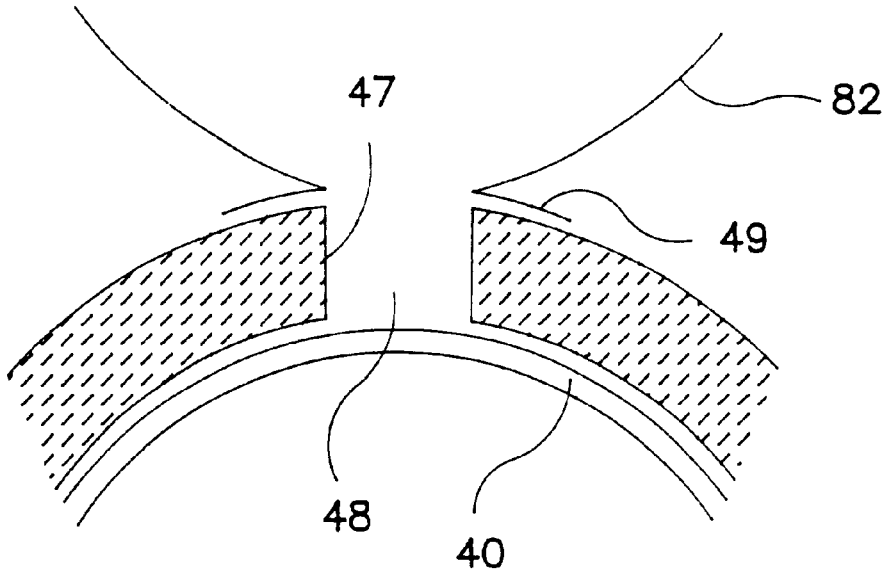

FIG. 8 is another embodiment utilizing a CPC. In this embodiment, the bulb is the same as in FIG. 7, whereas the light port is fiber optic 14", feeding CPC 70. In the embodiment of FIG. 8, less heat will reach the CPC than in the embodiment of FIG. 7.

A problem in the embodiments of FIGS. 6 to 8 is that there is an intersection between the bulb and the light port at which the light can escape.

This problem may be solved, referring to FIG. 3, by utilizing the interior, diffusely reflecting wall 47 of the orifice formed by the jacket in front of the aperture as a light port. Thus, referring to FIG. 9, a fiber optic 80 is disposed in front of the diffusing orifice, and ill FIG. 10, a solid or reflective optic 82 (e.g. a CPC) is disposed in front of the orifice. Light diffuses through the orifice and smoothly enters the fiber or other optic without encountering any abrupt intersections. Depending on the application, the diameter of the optic may be larger, smaller, or about the same size as the diameter of the orifice.

Figure 11:
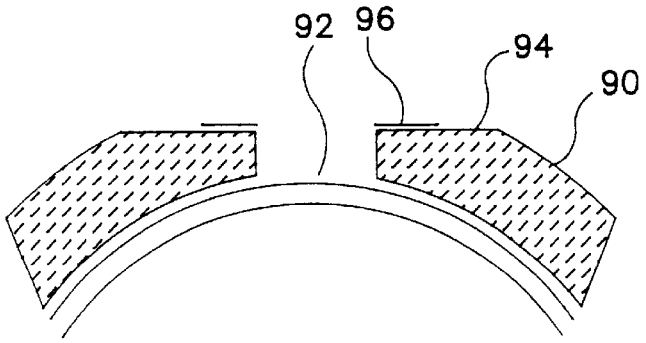
FIGS. 11 to 13 show further designs for diffusing orifices.
Figure 12:
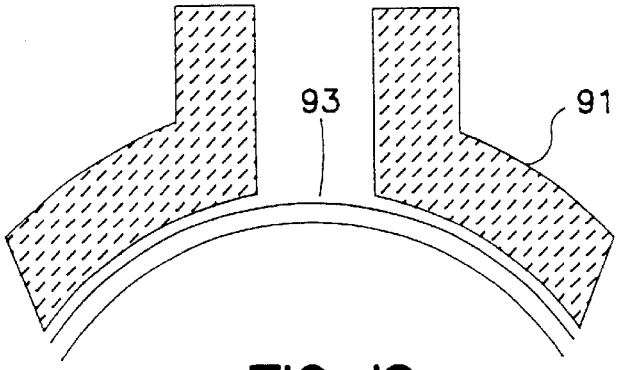
Figure 13:
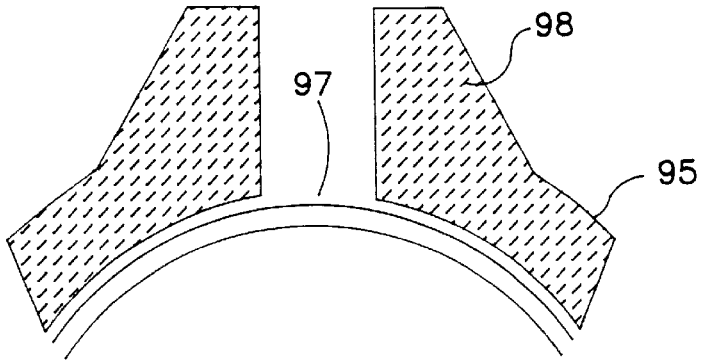

The diffusing orifice is made long enough so that it randomizes the light but not so long that too much light is absorbed. FIGS. 11 to 13 depict various orifice designs. In FIG. 11, the jacket 90 has orifice 92, wherein flat front surface 94 is present. In FIG. 12, the jacket 91 has orifice 93 having a length which extends beyond the jacket thickness. In FIG. 13 the jacket 95 has orifice 97 and graduated thickness area 98. The cross sectional shape of the orifice will typically be circular, but could be rectangular or have some other shape. The interior reflecting wall could be converging or diverging. These orifice designs are illustrative, and others may occur to those skilled in the art.

Referring to FIGS. 3, 9, 10 and 11, a reflector 49 (96 in FIG. 11) is shown. The reflector is placed in contact or nearly in contact with jacket 44, (see FIG. 3) and its function is to reflect light leaking out at or near the interface in the vicinity of the orifice. While the reflector is optional, it is expected to improve performance. Light reflected back into the ceramic near the interface will primarily find its way back into the aperture or bulb unless lost by absorption. The radial dimension (in the case where the orifice has a circular cross-section the reflector would be donut shaped and the dimension would be "radial") of reflector 49 should be about the same or smaller than the height of orifice 47. It is preferably quartz coated with a dielectric stack in the visible.

Figure 14:
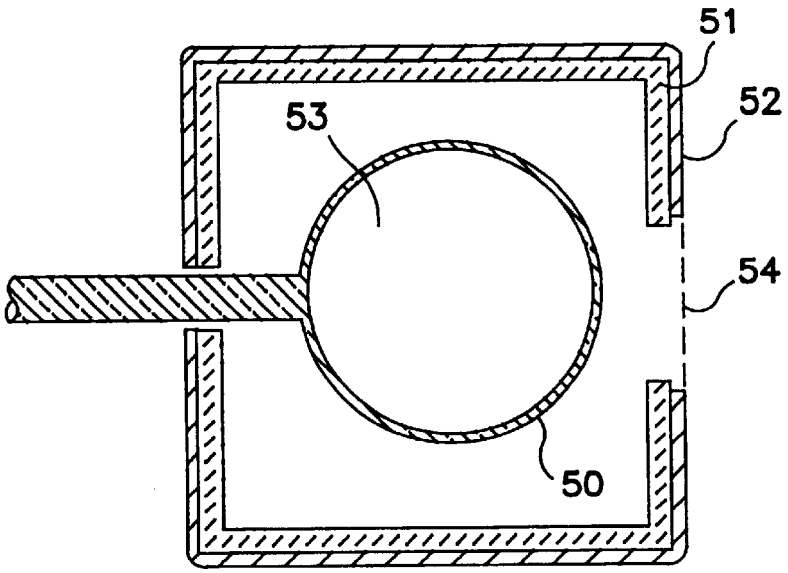
FIGS. 14 to 16 show further embodiments of the invention.

FIG. 14 depicts an embodiment of the invention wherein ultraviolet/visible reflective coating 51 is located on the walls of metallic enclosure 52. Within the enclosure is bulb 50 which encloses a fill 53 and does not bear a reflective covering. A screen 54, which is also the aperture, completes the enclosure. The reflective surface constrains the light produced to exit through the screen area. The enclosure may be a microwave cavity and microwave excitation may be introduced, e.g., through a coupling slot in the cavity. In the alternative, microwave or R.F. power could be inductively applied, in which the case the enclosure would not have to be a resonant cavity, but could provide effective shielding.

Figure 15:
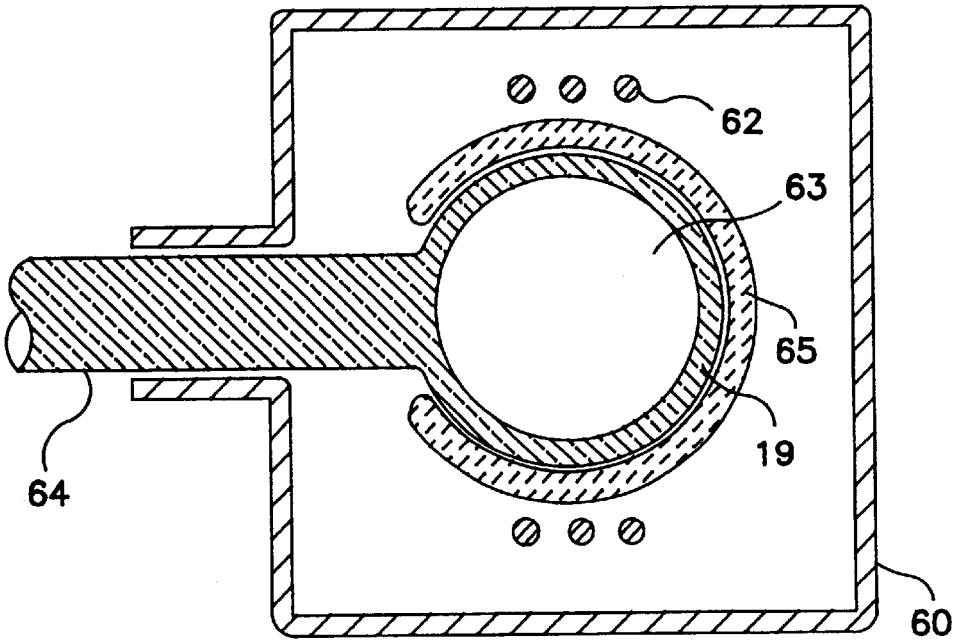

An embodiment in which effective shielding is provided is shown in FIG. 15. The bulb 19 encloses a fill 63 and is similar to that described in connection with FIG. 3, including a jacket 65 although in the particular embodiment illustrated it has a bigger alpha than is shown in FIG. 3. It is powered by either microwave or R.F. power, which excites coupling coil 62 (shown in cross-section) which surrounds the bulb. A Faraday shield 60 surrounds the unit for electromagnetic shielding except for the area around light port 64. If necessary, lossy ferrite or other magnetic shielding material may be provided outside enclosure 60 to provide additional shielding. In other embodiments, other optical elements may be in communication with the aperture, in which case, the Faraday shield would enclose the device except for the area around such optical elements. The opening in the closed box is small enough so that it is beyond cutoff. The density of the active substance in the fill can vary from the same as standard values to very low density values.

Figure 16:
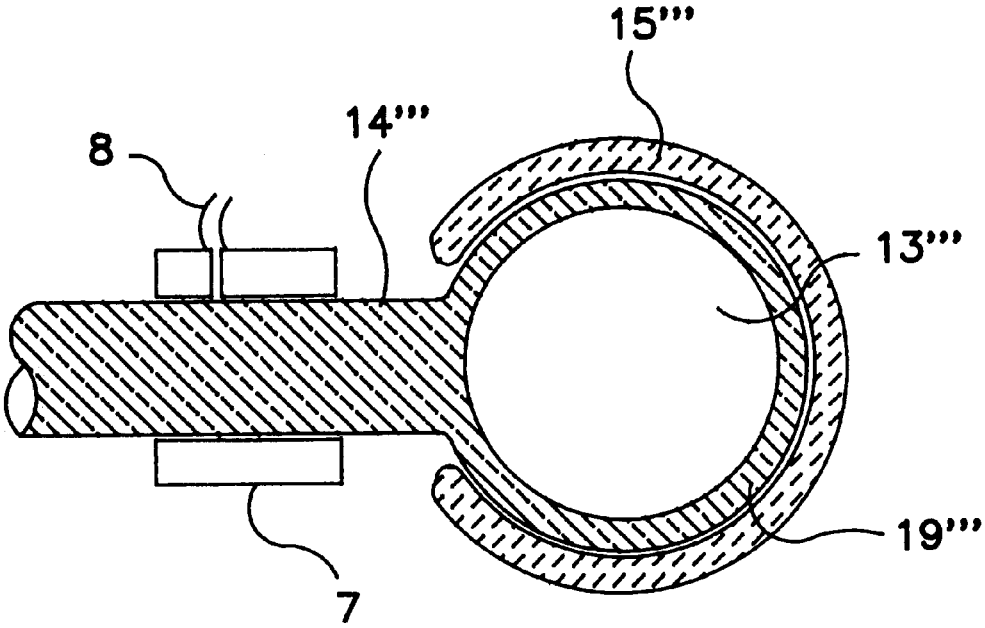

Although the invention is capable of providing stable production of visible light without bulb rotation, in certain applications, bulb rotation may be desirable. The embodiment of FIG. 16 depicts how this may be accomplished. Referring to FIG. 16, rotation is effected by an air turbine, so as not to block visible light. An air bearing 7 and air inlet 8 are shown and air from an air turbine (not shown) is fed to the inlet.

While the implementation of the method aspects of the invention have been illustrated in connection with reflecting media on the bulb or shielding enclosure interior, it is not so limited as the only requirement is that the reflective media be located so as to reflect radiation through the fill a multiplicity of times. For example, a dielectric reflector may be located to the exterior of the bulb. Also, in an embodiment using a microwave cavity having a coupling slot, loss of light can be avoided by covering the slot with a dielectric reflective cover.

Figure 17:
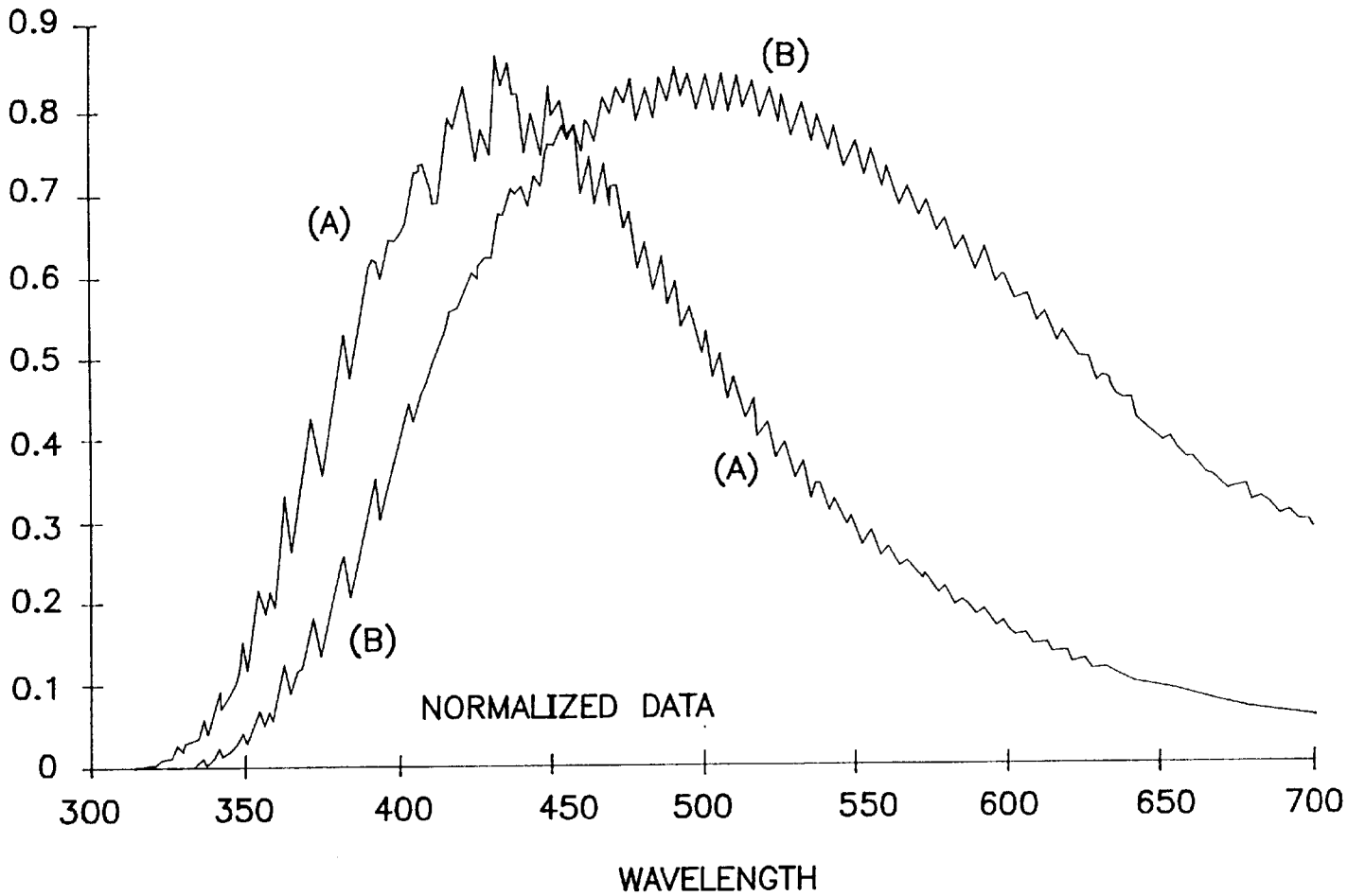
FIG. 17 shows a normalized spectral comparison between coated and uncoated bulbs for a microwave lamp embodiment.

The principle of wavelength conversion described above is illustrated in. connection with FIG. 17, which depicts spectra of respective electrodeless lamp bulbs containing a sulfur fill, in the ultraviolet and visible regions. Spectrum A is taken from such a bulb having a low sulfur fill density of about 0.43 mg/cc and not having any reflecting jacket or coating. It is seen that a portion of the radiation which is emitted from the bulb is in the ultraviolet region (defined herein as being below 370 nm).

Spectrum B. on the other hand, is taken from the same bulb which has been coated so as to provide multiple reflections in accordance with an aspect of the present invention. It is seen that a larger proportion of the radiation is in the visible region in Spectrum B, and that the ultraviolet radiation is reduced by at least (more than) 50%.

While spectrum B as depicted in FIG. 17 is suitable for some applications, it is possible to obtain spectra having even proportionately more visible and less ultraviolet by using coatings having higher reflectivity. As noted above, the smaller the aperture, the more relative visible output will be produced but the lower the efficacy. An advantage of the invention is that a bright source, for example which would be useful in some projection applications could be obtained by making the aperture very small. In this case, greater brightness would be obtained at lower efficacy.

In the lamp utilized to obtain spectrum B, a spherical bulb made of quartz having an ID of 33 mm and an OD of 35 mm was filled with sulfur at a density of 0.43 mg/cc and 50 torr of argon. The bulbs used in FIGS. 17 to 20 were used only to demonstrate the method of the invention, and were coated. As discussed above, bulbs employing coatings would not be used in a commercial embodiment because of problems with longevity. The bulb in FIGS. 17 and 18 was coated with alumina (G.E. Lighting Product No. 113-7-38,) to a thickness of 0.18 mm, except for the area at the aperture, and had an alpha of 0.02. The bulb was enclosed in a cylindrical microwave cavity having a coupling slot, and microwave power at 400 watts was applied, resulting in a power density of 21 watts/cc.

The spectra in FIG. 17 have been normalized, that is, the peaks of the respective spectra have been arbitrarily equalized. The lamp operation of FIG. 17 and FIG. 18 was without bulb rotation. The unnormalized spectra A and B are shown in FIG. 18.

Figure 19:
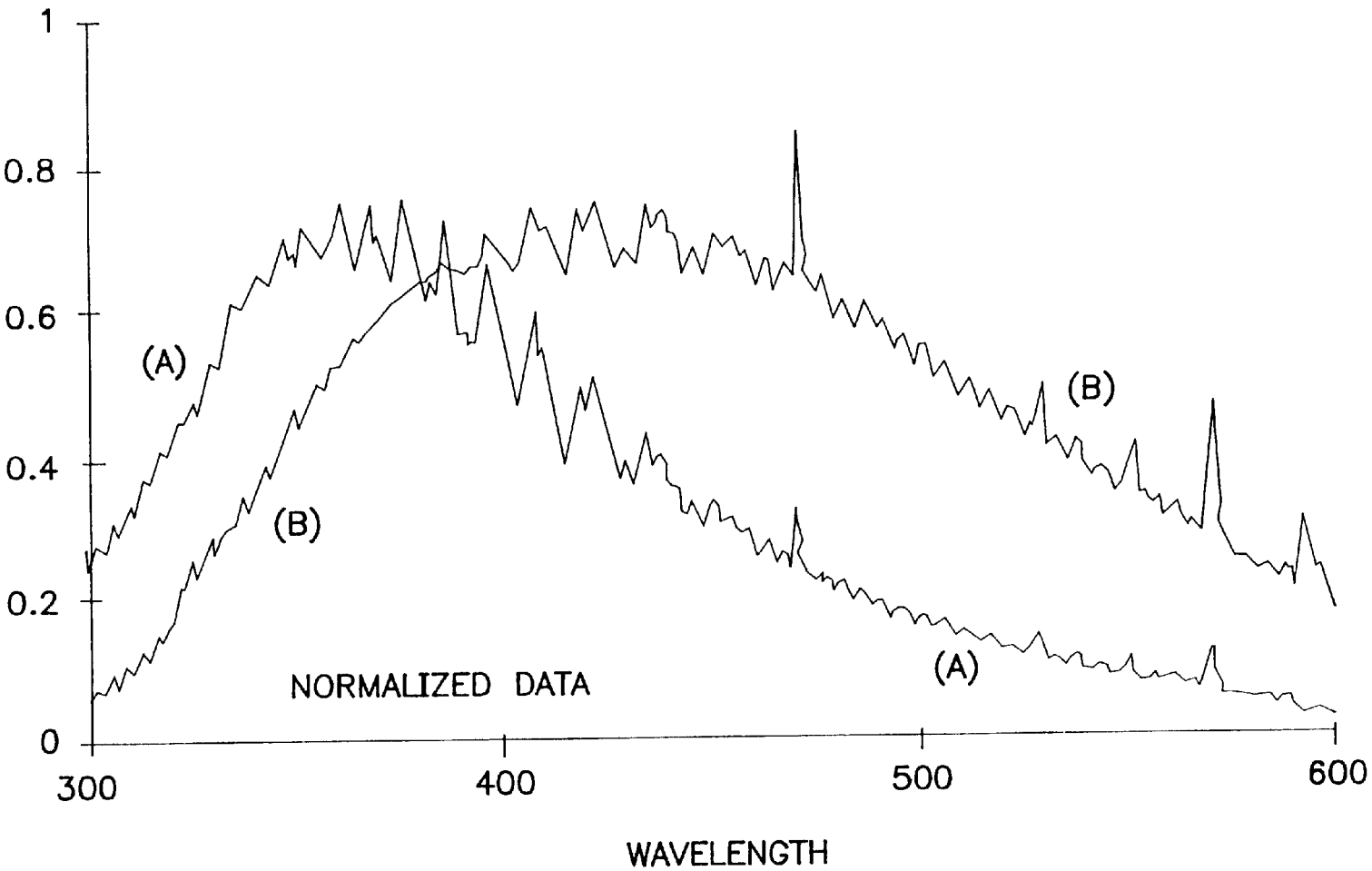
FIG. 19 shows a normalized spectral comparison between coated and uncoated bulbs for an R.F. lamp embodiment.
Figure 20:
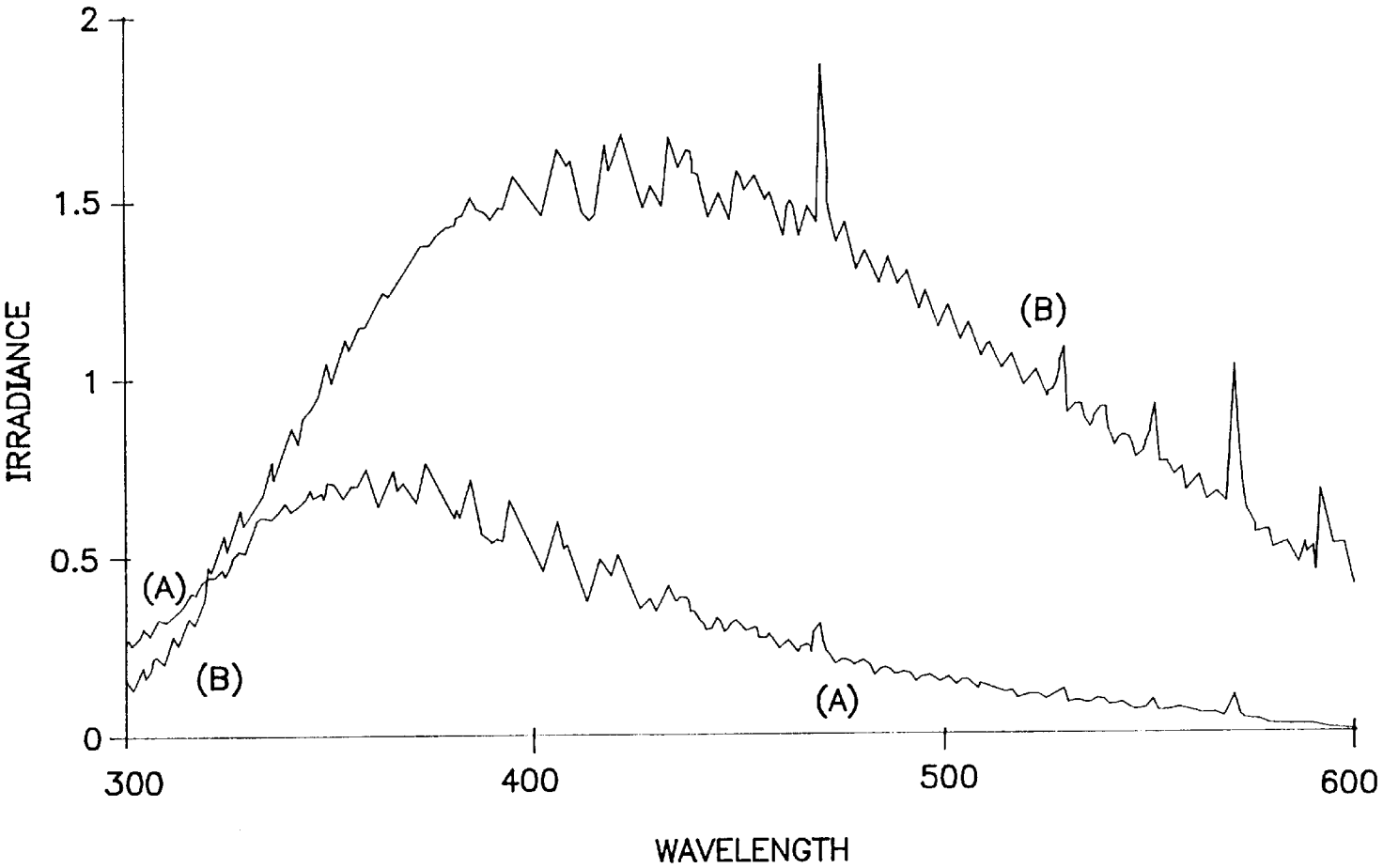
FIG. 20 shows a spectral comparison between coated and uncoated bulbs for an R.F. lamp embodiment.

FIG. 19 depicts normalized spectrum A taken for an R.F. powered sulfur lamp without a coating having a substantial spectral component in the ultraviolet region, and normalized spectrum B taken for the same lamp bearing a reflective coating. It is seen that there is proportionately more visible radiation in spectra B. In this case, the bulb had a 23 mm ID and a 25 mm OD, and was filled with sulfur at a density of 0.1 mg/cc and 100 torr of krypton. It was powered at 220 watts for a power density of 35 watts/cc. The coated bulb was coated with alumina at a thickness of about 0.4 mn, and the alpha was 0.07. The lamp operation was stable without bulb rotation, and the unnormalized spectra are shown in FIG. 20. Although radiation is lost in the multiple reflections, unnormalized spectra B appears higher than spectrum A because the detector used is subtended by only a fraction of the radiation emitted from an uncoated bulb, but by a greater fraction of the radiation emitted from an aperture.

Figure 18:
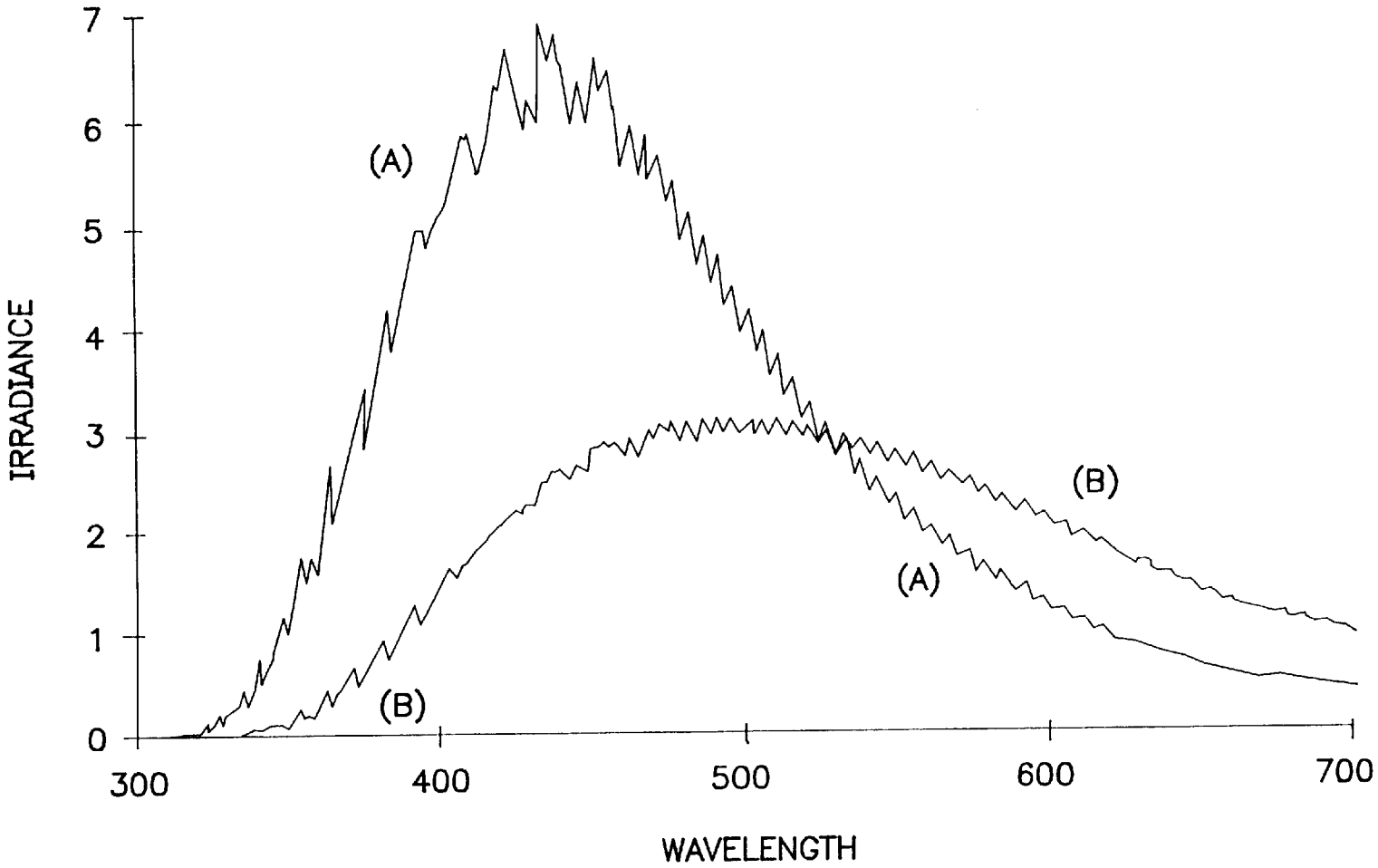
FIG. 18 shows a spectral comparison between coated and uncoated bulbs for a microwave lamp embodiment.

Comparing FIG. 18 with FIG. 20, it is noted that the larger alpha results in higher efficacy. Referring to FIG. 18, it is noted that the visible output is lower in the coated bulb than in the uncoated bulb since radiation is lost in the multiple reflections; however, the visible output is greater than it would have been if reflecting had occurred without conversion from the ultraviolet to the visible having had also occurred.

In accordance with the invention, in some embodiments the bulbs may be filled with much lower densities of active material than in the prior art.

The invention may be utilized with bulbs of different shapes, e.g., spherical, cylindrical, oblate spheroid, toroidal, etc. Use of lamps in accordance with the invention include as a projection source and as an illumination source for general lighting.

It should be noted that bulbs of varying power from lower power (e.g., 50 watts). to 300 watts and above including 1000 watt and 3000 watt bulbs may be provided. Since the light may be removed via a light port, loss of light can be low, and the light taken out via a port may be used for distributed type lighting, e.g., in an office building.

In accordance with another aspect of the invention, the bulbs and lamps described herein may be used as a recapture engine to convert ultraviolet radiation from an arbitrary source to visible light. For example, an external ultraviolet lamp may be provided, and the light therefrom may be fed to a bulb as described herein through a light port. The bulb would then convert the ultraviolet radiation to visible light.

Finally, it should be appreciated that while the invention has been disclosed in connection with illustrative embodiments, variations will occur to those skilled in the art, and the scope of the invention is defined by the claims which are appended hereto.

What is claimed is:

1. A discharge lamp, comprising:

an envelope;

a fill which emits light when excited disposed in the envelope, the fill being capable of absorbing light and re-emitting the absorbed light, the light emitted from the fill having a first spectral power distribution in the absence of reflection of light back into the fill;

a reflector disposed around the envelope and defining an opening, the reflector being configured to reflect some of the light emitted by the fill back into the fill while allowing some light to exit through the opening, the exiting light having a second spectral power distribution different from the first spectral power distribution;

a source of excitation power coupled to the fill to excite the fill and cause the fill to emit light: and an optical element spaced from the envelope and configured to reflect an unwanted component of light which exited the envelope back into the envelope through the opening in the reflector.

2. The lamp as recited in claim 1, wherein the fill is capable of recapturing the unwanted components of light and converting at least some of the recaptured light to useful light.

3. The lamp as recited in claim 1, wherein the optical element is further configured to pass other components of light.

4. The lamp as recited in claim 1, wherein the unwanted component of light comprises at least one of a selected wavelength region and a selected spatial orientation.

5. A discharge lamp, comprising:

an envelope;

a fill which emits light when excited disposed in the envelope, a source of excitation power coupled to the fill to excite the fill and cause the fill to emit light; and a reflector disposed around the envelope and defining an opening, the reflector being configured to reflect some of the light emitted by the fill back into the fill while allowing some light to exit through the opening, wherein the reflector comprises a material having a similar thermal index of expansion as compared to the envelope and which is closely spaced to the envelope.

6. The lamp as recited in claim 5, wherein the reflector defines a diffusing orifice through which light exits the lamp.

7. The lamp as recited in claim 6, wherein the diffusing orifice comprises side walls which are tong enough to randomize light exiting from the diffusing orifice.

8. The lamp as recited in claim 5, wherein the reflector defines an aperture through which light exits the envelope, and further comprising:

a second reflector disposed adjacent the aperture and configured to recapture light which might otherwise be lost at an interface of the aperture.

9. The lamp as recited in claim 5, wherein the reflector contacts the envelope in one or more locations and otherwise is spaced from the envelope within about several thousandths of an inch.

10. The lamp as recited in claim 5, wherein the reflector material does not adhere to the envelope.

11. The lamp as recited in claim 5, wherein the reflector material is the same material as the envelope but with a different structure.

12. The lamp as recited in claim 11, wherein the envelope material is quartz and the reflector material includes silica.

13. The lamp as recited in claim 5, wherein the reflector comprises a container having walls spaced from the bulb and a reflecting powder is disposed in a gap between the container walls and the envelope.

14. The lamp as recited in claim 5, wherein the reflector comprises a jacket having a rigid structure.

15. The lamp as recited in claim 14, wherein the jacket comprises two ceramic shells integrally connected to each other.

* * * * *